US011656055B2

(12) United States Patent
Steindl et al.

(10) Patent No.: US 11,656,055 B2
(45) Date of Patent: May 23, 2023

(54) SLIDE COVER PLATE FOR THE SLIDE OF A STRIKER-FIRED HAND GUN

(71) Applicants: Andreas Steindl, Budapest (HU); Mikael Torma, Budapest (HU)

(72) Inventors: Andreas Steindl, Budapest (HU); Mikael Torma, Budapest (HU)

( * ) Notice: Subject to any disclaimer, the term of this patent is extended or adjusted under 35 U.S.C. 154(b) by 114 days.

(21) Appl. No.: 17/386,330

(22) Filed: Jul. 27, 2021

(65) Prior Publication Data

US 2021/0389078 A1 Dec. 16, 2021

Related U.S. Application Data

(63) Continuation-in-part of application No. PCT/HU2020/050003, filed on Jan. 23, 2020.

(51) Int. Cl.
*F41A 35/02* (2006.01)
*F41A 3/66* (2006.01)

(52) U.S. Cl.
CPC ..... *F41A 35/02* (2013.01); *F41A 3/66* (2013.01)

(58) Field of Classification Search
CPC ..... F41A 35/02; F41A 3/66
See application file for complete search history.

(56) References Cited

U.S. PATENT DOCUMENTS

| | | | | |
|---|---|---|---|---|
| 9,285,186 | B1 * | 3/2016 | Di Veroli | F41G 1/32 |
| 2011/0154710 | A1 * | 6/2011 | Hatfield | F41A 19/34 42/90 |
| 2017/0211901 | A1 * | 7/2017 | Keller | F41A 3/66 |
| 2022/0163276 | A1 * | 5/2022 | Kroyer | F41A 11/00 |

* cited by examiner

*Primary Examiner* — J. Woodrow Eldred
(74) *Attorney, Agent, or Firm* — Olson & Cepuritis, Ltd.

(57) ABSTRACT

A slide cover plate (1) for the slide (2) of a striker-fired hand gun, closes the end portion (4) of the slide (2) opposite to the muzzle (3) and provides support for an end portion (11) of a spring striker unit (5) and/or an end portion (21) of a spring extractor unit (15) inside of the slide (2). The slide cover plate (1) received into a groove (7) provided in the end portion (4) of the slide (2), where the slide cover plate (1) is fixed in its position. The slide cover plate (1) comprises a backwardly protruding part having larger face area than the cross sectioned area of the slide (2) at its end portion (4). The slide cover plate (1) comprises a hollow section, which forms a recess for reaching the end portion (11) of the spring striker unit (5) and/or the end portion (21) of the spring extractor unit (15) by tool when the slide cover plate (1) is pushed into the groove (7) but is at an intermediate position different from the terminal position, said hollow section and recess extend behind the face area of the backwardly protruding part in the direction of the longitudinal axis of the slide (2).

12 Claims, 4 Drawing Sheets

SLIDE COVER PLATE FOR THE SLIDE OF A STRIKER-FIRED HAND GUN

CROSS-REFERENCE TO RELATED APPLICATIONS

This application is a continuation-in-part of PCT/HU2020/050003, filed Jan. 23, 2020, which claims priority to Hungarian Patent Application No. U1900011 filed Jan. 28, 2019, each of which is incorporated herein by reference.

FIELD OF INVENTION

The present invention relates to a slide cover plate for the slide of a striker-fired hand gun.

BACKGROUND OF INVENTION

Striker-fired hand guns with a slide comprising firing structure and other spring elements and having at the back end of the slide a planar slide cover plate are known. The slide can be pushed into a groove provided at the back end of the side. The slide cover plate constitutes a base support for a spring striker unit and for a spring extractor unit or other spring elements when pushed to the end position.

Among such striker-fired hand guns having a slide cover plate is the Glock family of hand guns (and their clones) as one of the most common examples.

SUMMARY OF INVENTION

An improved slide cover plate of increased size, but interchangeable with a standard slide cover plate, fits in the standard groove of the slide of a hand gun and provides additional functions. When the slide cover plate of the present invention is introduced into the standard groove, it can be received in its terminal or final position in the same manner as a standard cover plate. For this purpose, a special feature is provided which allows pushing the spring elements, and especially the end of the spring striker unit, by a tool while the cover plate is positioned on the slide. Without this feature, the spring elements in the slide would prevent the slide cover plate to be fixed in its terminal position.

The slide cover plate comprises a backwardly protruding part having larger face area than the cross sectioned area of the slide at its end, and the slide cover plate comprises a hollow section, which forms a recess configured for reaching the end of the spring striker unit and/or the end of the spring extractor unit by a tool when the slide cover plate is pushed into the groove but is in an intermediate position different from the terminal position. The hollow section and recess is provided facing the slide of the hand gun, i.e., on the side opposite the larger face area.

The improved slide cover plate according to the present invention is preferably of a single piece—i.e. metal, cast technology—and provides a surface suitable for different purposes. Such as, among others, for bearing subtitles, logos, or as small light emission devices. The side wings may promote or ease the grip of the slide, essentially when performed by thumb and index finger. The upward protruding area size enhancement will not cause a problem with wearing and getting out, the overall measures will not increase. The increased area under some circumstances will facilitate single hand loading.

The slide cover plate according to the present invention is preferably of the kind containing a striker pin indicator. This can be a borehole and a pin movable in the borehole. In this way the user can easily determine the state of the gun.

DESCRIPTION OF THE PREFERRED EMBODIMENTS

Figure 1:
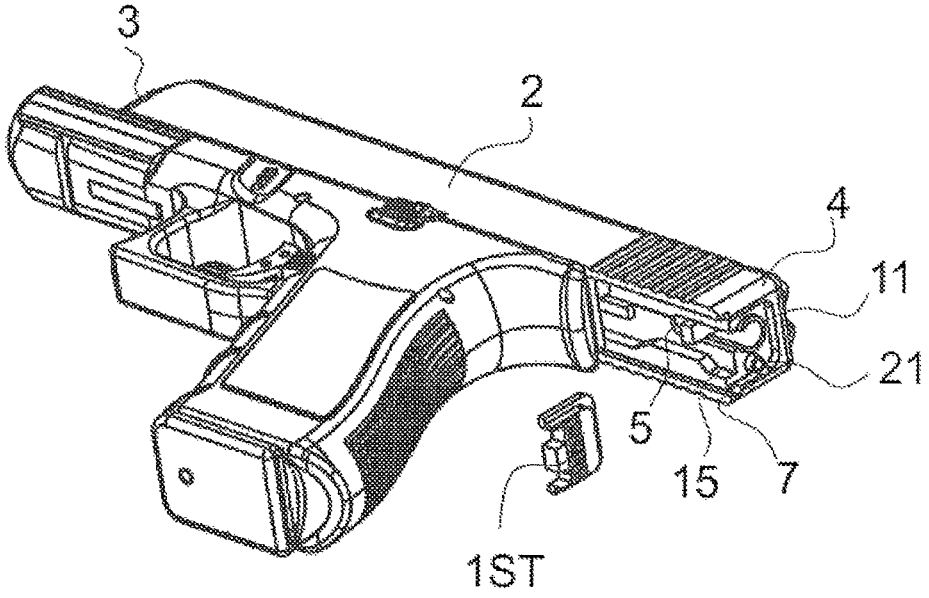
FIG. 1 is a perspective view of a known striker-fired hand gun and an original slide cover plate in a spaced relationship to the hand gun.

FIG. 1 shows a known striker-fired hand gun with an original slide cover plate, in perspective view, according to the state of the art. In the slide 2 the closing the end portion 4 of slide 2, opposite to the muzzle 3, is closed by an original slide cover plate 1ST. This at the same time provides support for an end portion 11 of a spring striker unit 5 and/or an end portion 21 of a spring extractor unit 15 inside of the slide 2. The original slide cover plate 1ST is pushed from below into a groove 7 situated in a cross direction to the longitudinal axis of the slide 2. For this operation, an appropriate tool is necessary to compress the spring(s), preferably on the end portions 11 and/or 21, and then keep pushing the end portions 11 and/or 21.

Figure 2:
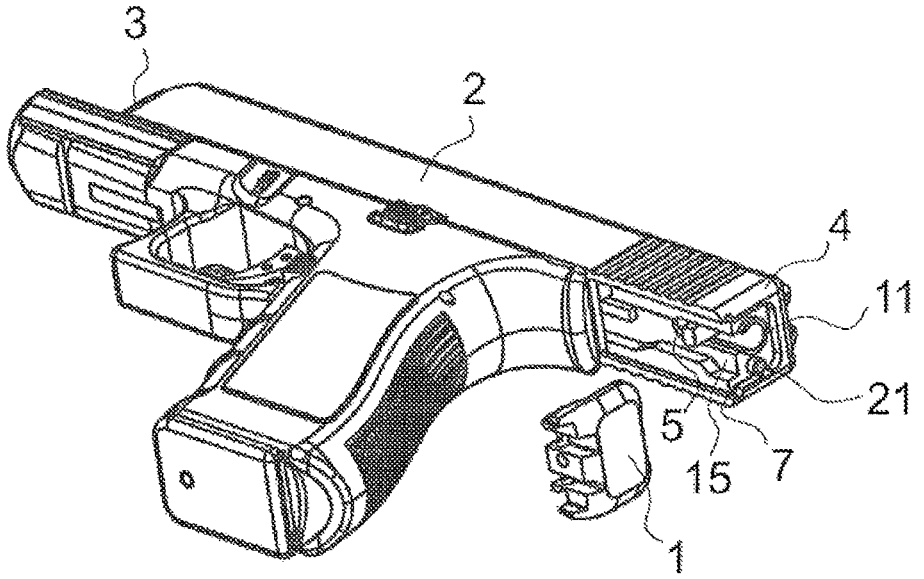
FIG. 2 is a perspective view of the hand gun of FIG. 1 with the slide cover plate embodying the present invention spaced from the hand gun.

FIG. 2 shows the same hand gun as seen in FIG. 1, but with the original slide cover plate 1ST replaced by a new slide cover plate 1 embodying the present invention. In this case, the end portion 11 and/or end portion 21 cannot be reached because the slide cover plate 1 is larger in the direction of push. The reach by tool would be impossible.

The above-mentioned facts are illustrated in FIGS. 3-6 from a different view.

Figure 3:
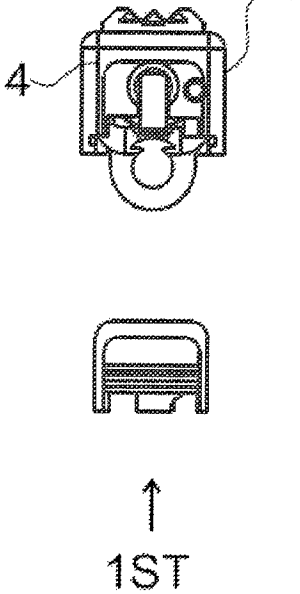
FIG. 3 is an end view of the hand gun of FIG. 1 and an original slide cover plate spaced from the hand gun.

FIG. 3 shows end portion 4 of slide 2 and the original slide cover plate 1ST in back view.

Figure 4:
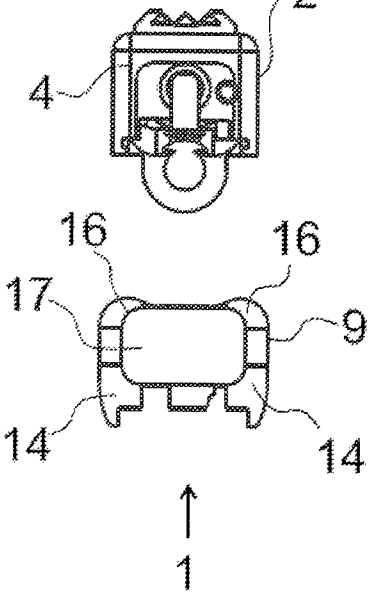
FIG. 4 is an end view of the hand gun of FIG. 1 and a slide cover plate embodying the present invention spaced from the hand gun.

FIG. 4 shows in similar back view the end portion 4 of the slide 2 and end of the slide cover plate 1 of the present invention to be pushed. Here the new slide cover plate 1 comprises a backwardly protruding part 9 having larger face area 17 than the cross sectioned area of the slide 2 at its end portion 4. The backwardly protruding part 9 further may comprise an upright protruding elevated rim 16, and two side wings 14 for enhanced grip. In this embodiment, the wings together with the upright protruding elevated rim 16 form together a rounded corner square as the face area 17. The face area 17 of backwardly protruding part 9 may bear text and/or logo, if desired.

Figure 5:
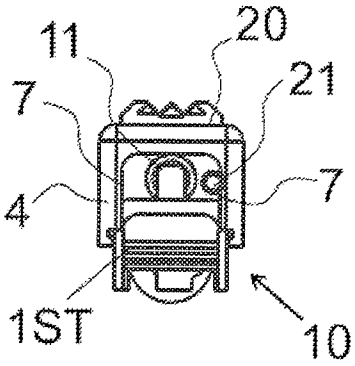
FIG. 5 is an end view of the hand gun of FIG. 1 showing an original slide cover plate partially pushed in place.

FIG. 5 shows the original slide cover plate 1ST which is in an intermediate position 10. To move further a tool is necessary to push end portion 11 and then end portion 21.

Figure 6:
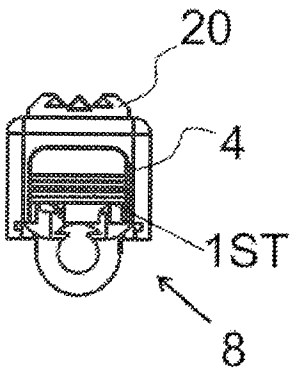
FIG. 6 is an end view of the hand gun of FIG. 1 showing an original slide cover plate pushed in place.

FIG. 6 shows the original slide cover plate 1ST is in at final position 8 after the push movement has been finished.

Figure 8:
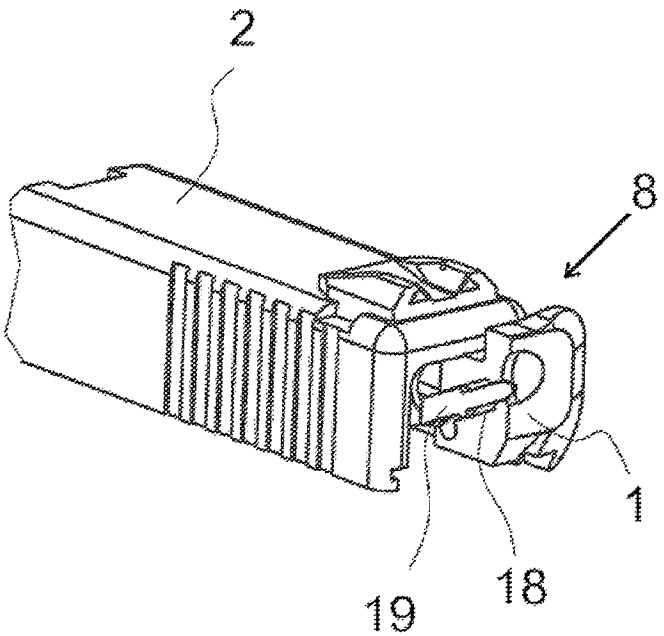
FIG. 8 is a partial perspective view of the slide of a hand gun with a slide cover plate embodying the present invention and having a different portion thereof broken away to show interior detail.
Figure 7:
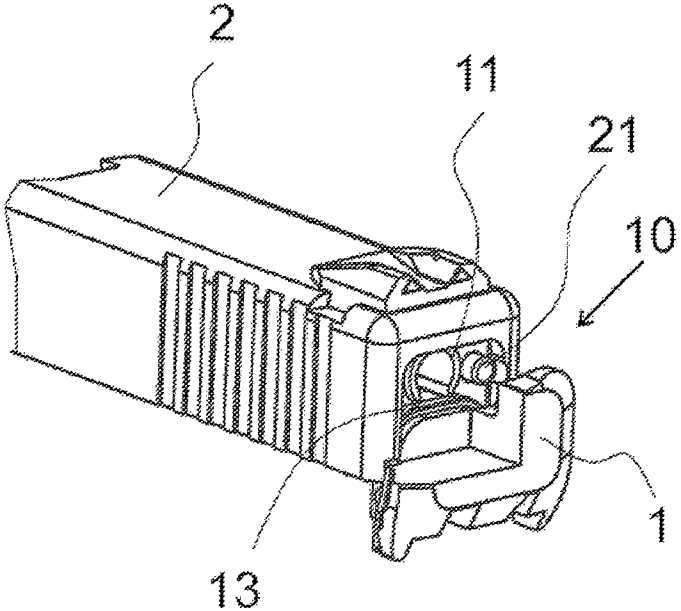
FIG. 7 is a partial perspective view of the slide of a hand gun with a slide cover plate embodying the present invention partially pushed in place and having a portion thereof broken away to show interior detail.

FIG. 7 shows the slide 2 with half pushed slide cover plate. A recess 13 can be seen, through which the end portions 11 and 21 can be pushed inwardly. In FIG. 8 the slide cover plate 1 is in its final position 8.

Figure 9:
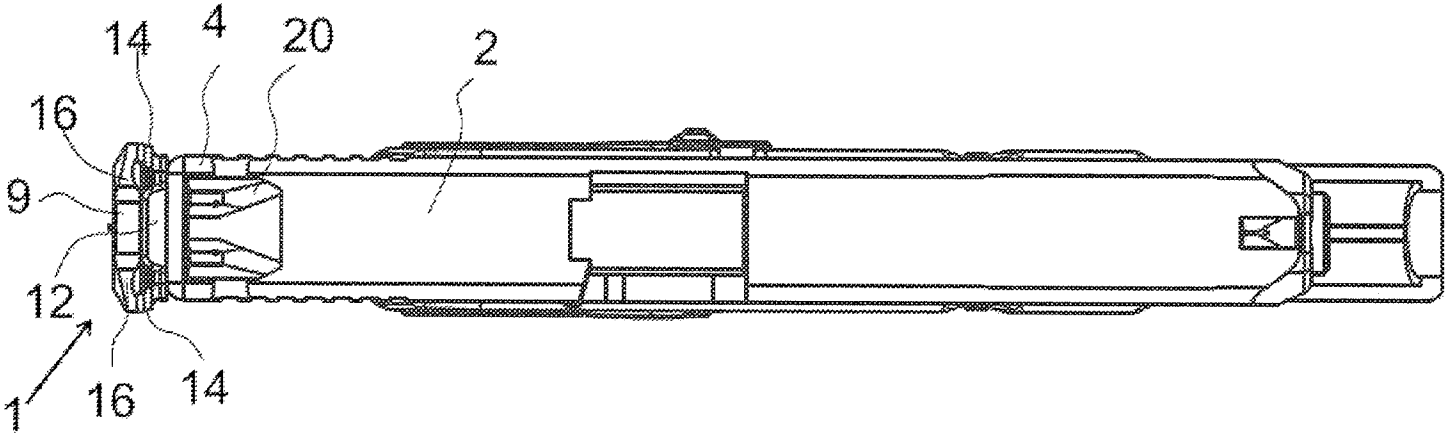
FIG. 9 is a bottom view of the slide of a hand gun, viewed from below, with a slide cover plate embodying the present invention in place.

FIG. 9 shows the slide 2 with fully pushed slide cover plate 1. The backwardly protruding part 9 comprises a larger face area than the cross sectioned area of the slide 2 at its end portion 4. It also shows that the slide cover plate 1 comprises a hollow part 12, which forms a recess for reaching the end of the spring striker unit and/or the end portion 21 of the spring extractor unit by a tool when the slide cover plate 1 is pushed into the groove but is in an intermediate position different from the terminal position. Hollow section 12 and recess extend on opposite side of the face area 17 of the backwardly protruding part 9 in the direction of the longitudinal axis of the slide 2.

The slide cover plate 1 of the present invention can be made in one single piece for example by moulding or casting. In another embodiment, the backwardly protruding part 9 is carrying on its face area 17 a light emitting display means.

In an embodiment the backwardly protruding part 9 may include a striker pin indicator. The striker pin indicator can be a borehole 18 and a pin 19 movable in the borehole. The pin 19 can be protruding and/or conspicuous in its colour.

The slide cover plate 1 of the present invention can be used in certain airsoft guns and airguns, if the respective parts are removable in those guns. The existence, location, and function of the mentioned spring elements may be different from that of the corresponding ones in real firearms.

The slide cover plate 1 of the present invention can include a dedicated electronic RFID identification tag for promoting quick and easy identification of guns, or any other kind of dedicated electronic chip with an electric power source. In this latter case different goals can also be achieved, such as, for e.g., logging number and time of shots. This can be realised using integrated accelerometer and clock. These features may be advantageous among others in case of duty pistols where the identification is necessary before and after duty, and logging during duty. The corresponding RFID identification tag or the dedicated electronic chip with electric power source may be moulded inside, glued or mechanically attached to the slide cover plate 1. The RFID identification tag in one embodiment is comprising a programmable RFID identification chip.

The advantage of the present invention is a simple and easily manufactured element, which is quickly rechargeable and reliably placed instead of the original one. Furthermore, it provides usable space for special clips, e.g. pockets or belts.

The invention claimed is:

1. A slide cover plate (1) for a slide (2) of a striker-fired hand gun, supporting an end portion (11) of a spring striker unit (5) and/or an end portion (21) of a spring extractor unit (15) inside the slide (2), the slide cover plate (1) received into a groove (7) formed in an end portion of the slide (2), where the slide cover plate (1) is fixed in its position (8), characterized in that the slide cover plate (1) comprises a backwardly protruding part (9) having larger face area (17) than the cross sectioned area of the slide (2) at end portion (4) thereof, and the slide cover plate (1) comprises a hollow section (12), which forms a recess (13) configured for reaching the end portion (11) of the spring striker unit (5) and/or the end portion (21) of the spring extractor unit (15) by tool when the slide cover plate (1) is pushed into the groove (7) but is in an intermediate position (10) different from a terminal position (8), said hollow section (12) and recess (13) are positioned on opposite side of the face area (17) of the backwardly protruding part (9) in the direction of the longitudinal axis of the slide (2).

2. The slide cover plate according to claim 1 characterized in that the backwardly protruding part (9) comprises an upright protruding elevated rim (16).

3. The slide cover plate according to claim 1 characterized in that the backwardly protruding part (9) comprises two side wings (14) for enhanced grip.

4. The slide cover plate according to claim 3 characterized in that the backwardly protruding part (9) comprises two side wings (14) for enhanced grip which wings together with the upright protruding elevated rim (16) form together a rounded corner square as said face area (17).

5. The slide cover plate according to claim 1 characterized in that the backwardly protruding part (9) constitutes a face area (17) bearing text and/or logo.

6. The slide cover plate according to claim 1 characterized in that the backwardly protruding part (9) comprises a striker pin indicator.

7. The slide cover plate according to claim 6 characterized in that the striker pin indicator is a borehole (18) and a pin (19) movable in the borehole.

8. The slide cover plate according to claim 1 characterized in that it is one single piece.

9. The slide cover plate according to claim 1 characterized in that the backwardly protruding part (9) is carrying on its face area (17) a light emitting display means.

10. The slide cover plate according to claim 1 characterized in that it is adapted to fit an airsoft gun or an airgun.

11. The slide cover plate according to claim 1 comprising a dedicated electronic RFID identification tag or other kind of dedicated electronic chip.

12. The slide cover plate according to claim 11 comprising a dedicated electronic chip with electric power source, where the chip is configured to log number and time of shots.

* * * * *